US008684458B2

(12) United States Patent
Lee

(10) Patent No.: US 8,684,458 B2
(45) Date of Patent: Apr. 1, 2014

(54) SWING WITH A FOLDING BACK THAT AUTOMATICALLY LOCKS THE SWING

(75) Inventor: Clifton Shao-ming Lee, Hillsborough, CA (US)

(73) Assignee: Numark Industries Company Limited, Hung Hom (CN)

( * ) Notice: Subject to any disclaimer, the term of this patent is extended or adjusted under 35 U.S.C. 154(b) by 313 days.

(21) Appl. No.: 13/136,630

(22) Filed: Aug. 5, 2011

(65) Prior Publication Data

US 2013/0033075 A1 Feb. 7, 2013

(51) Int. Cl.
*A63G 9/00* (2006.01)

(52) U.S. Cl.
USPC ..... 297/280; 297/277; 297/281; 472/118

(58) Field of Classification Search
USPC ..... 297/273, 277, 278, 281, 282; 472/118
See application file for complete search history.

(56) References Cited

U.S. PATENT DOCUMENTS

| | | | | |
|---|---|---|---|---|
| 5,957,780 | A * | 9/1999 | Grazioli | 472/118 |
| 6,348,005 | B1 * | 2/2002 | Tseng | 472/118 |
| 6,648,768 | B1 * | 11/2003 | Tseng | 472/118 |
| 6,672,665 | B1 * | 1/2004 | Tseng | 297/281 |
| 6,715,831 | B1 * | 4/2004 | Tseng | 297/281 |
| 6,857,701 | B1 * | 2/2005 | Liu | 297/281 |
| 7,862,442 | B2 * | 1/2011 | Tseng | 472/118 |
| 2003/0071499 | A1 * | 4/2003 | Tseng | 297/281 |
| 2006/0261652 | A1 * | 11/2006 | Tseng | 297/277 |
| 2009/0236886 | A1 * | 9/2009 | Tseng | 297/281 |

* cited by examiner

*Primary Examiner* — Peter Brown
(74) *Attorney, Agent, or Firm* — Daniel Hopen

(57) ABSTRACT

A swing assembly has a seat with a folding back that locks the swing automatically when the back folds from an upright configuration to a flat configuration so the swing is stable. The swing assembly includes an upper cross bar having two ends, a lower cross bar having two ends and a lateral support attached to each end of the upper cross bar and the lower cross bar, respectively. The swing assembly has a seat with two ends and a back. The back foldably attaches to the seat. A pair of seat supports attached to each end of the seat and moveably attach to a hanging support mounted on the upper cross bar adjacent each lateral support. A lower back support hangs from the seat back to automatically aligns with and lock with the lower cross bar when the swing moves from the upright configuration to the flat configuration.

13 Claims, 7 Drawing Sheets

SWING WITH A FOLDING BACK THAT AUTOMATICALLY LOCKS THE SWING

FIELD OF THE INVENTION

This invention relates to swings and benches that move for the enjoyment of a user, and particularly to outdoor swings.

BACKGROUND OF THE INVENTION

Furniture can be found in most homes. Many enjoy outdoor furniture. It is very common to see outdoor furniture that swings to enable the user to more fully relax when using the furniture. During the warmer months, many prefer shade to direct sunlight. Accordingly many outdoor swing assemblies have a canopy to shade users.

U.S. Pat. No. 6,402,233 to Tseng discloses a swing assembly with an adjustable canopy. The seat has a fixed back. The swing assembly includes lateral supports that interconnect via an upper cross bar and a lower cross bar. A pair of hanging supports connects the seat with the upper cross bar to allow the seat to swing.

One drawback of this swing is that the seat back is fixed so it can neither be adjusted nor folded. It may be more difficult to rest on a swing with a fixed back. Accordingly, it is desirable to have a swing that enables a user to more comfortably rest.

SUMMARY OF THE INVENTION

A swing assembly has a seat with a folding back that locks the swing automatically when the back folds from an upright configuration to a flat configuration. In this way a user can be secure while lying on the swing in the flat configuration.

The swing assembly includes an upper cross bar having two ends, a lower cross bar having two ends and a lateral support attached to each end of the upper cross bar and the lower cross bar, respectively.

The swing assembly has a seat with two ends and a back. The back foldably attaches to the seat. A pair of seat supports attached to each end of the seat and moveably attach to a hanging support mounted on the upper cross bar adjacent each lateral support.

The back of the seat is foldable to a flat configuration, which automatically locks the seat. In particular, the back of the seat includes a lower back support normally hanging from the back of the seat. The lower back support automatically locks against the lower cross bar when the seat back folds into the flat configuration. This is accomplished in a unique way.

In particular as the seat back folds from an upright configuration to a flat configuration, the lower back support automatically aligns with a back support connector mounted on the lower cross bar. As the seat back folds closer to the flat configuration, the back support connector inserts into the back support connector, preventing the seat from swinging.

While there are various configurations possible for the back support connector, a "C" shaped configuration is used in a preferred embodiment. The back support connector particularly defines a channel for receiving the lower back support.

As the seat back lifts from the flat configuration to the upright configuration, the back support connector releases the lower back support and the seat is then able to swing again.

DETAILED DESCRIPTION OF PREFERRED EMBODIMENT

Figure 1:
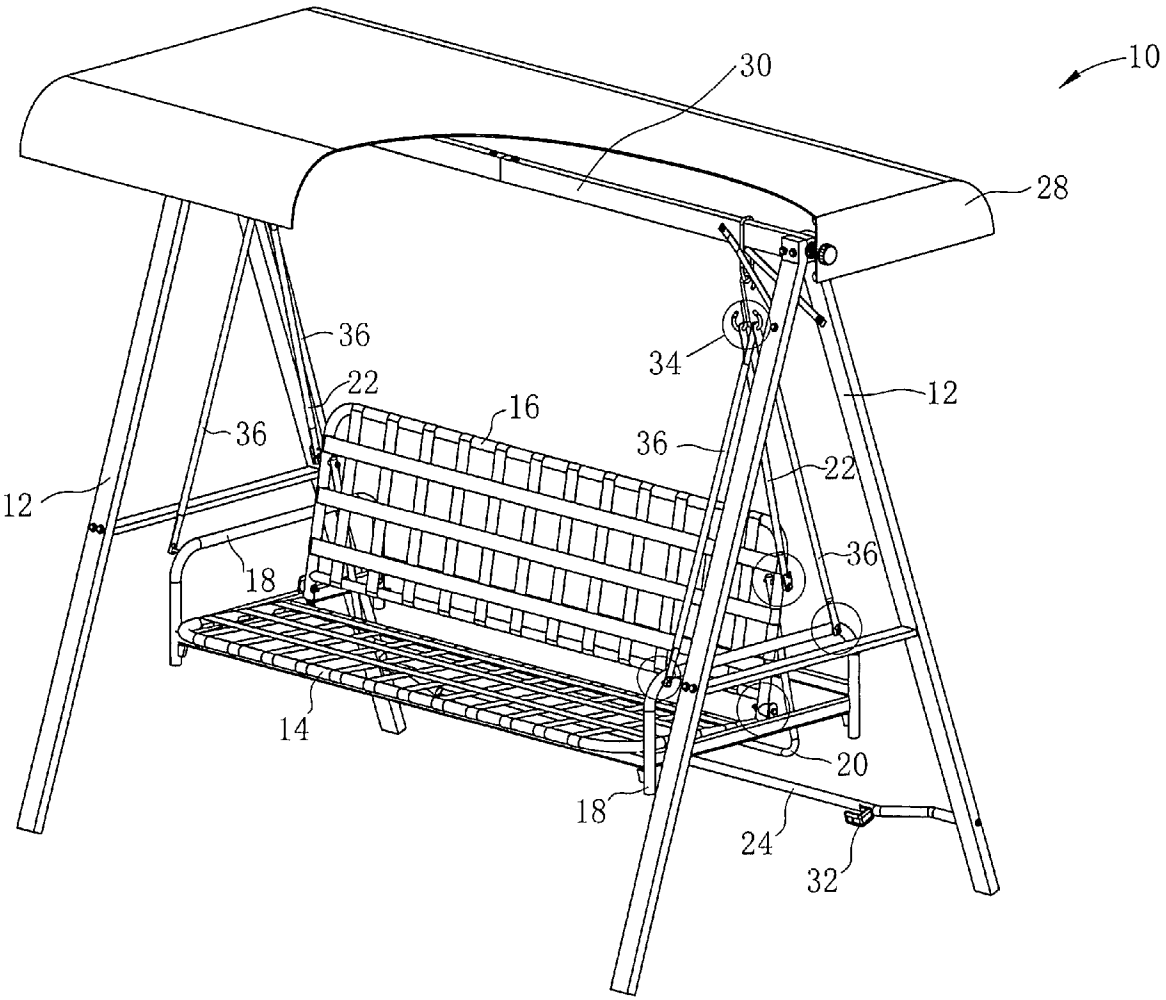
FIG. 1 shows a perspective view of a swing assembly in accordance with the present invention in an upright configuration.

FIG. 1 shows a swing assembly generally designated by the reference numeral 10. The swing assembly 10 includes a pair of lateral supports 12, and a seat 14 having a back 16 and arms 18. The seat 14 has two ends and the arms mount on each end of the seat 14. The lateral supports 12 secure the swing assembly, enabling the seat to swing without wobbling the swing assembly.

The swing assembly 10 includes a lower cross beam 24, canopy 28 and an upper cross beam 30, which maintain parallel alignment of the lateral supports 12. The lower cross beam 24 interconnects the lateral supports 12 at a lower portion of the lateral supports 12. The upper cross beam 30 interconnects the lateral supports 12 at an upper portion of the lateral supports 12. The canopy 28 mounts on the upper cross beam 30. Accordingly, the lateral supports 12 and the cross beams 24 and 30 create a rigid and fixed structure to enable the swing assembly 10 to be stable, particularly when the seat 14 of the swing assembly 10 moves in a swinging motion.

The upper cross beam 30 includes a pair of hanging supports 34 adjacent each lateral support 12, and four seat supports 36. The seat supports 36 each have two ends. One end of the seat supports 36 is moveably mounted to a hanging support 34 to the upper cross beam 30 near each of the lateral supports 12. The seat supports 36 mount on the arms 18 of the seat 14 in one embodiment of the invention. It can be appreciated that when the seat swings, that the hanging supports 34 rotate with respect to the seat 14. This rotation enables the seat to swing easily.

The seat supports 36 hang the seat 14 from the hanging support 34. Preferably the hanging support includes a pair of hooks that moveably connect to ends of the seat supports 36.

The back 16 has two lateral ends. An upper back support 22 attaches to the back 16 from the hanging support 34 to maintain the back in an upright position. A lower back support 20 mounts on the back at each of the lateral ends. The lower back support 20 hangs from the back 16 when the seat 14 is upright as shown. The lower back support 20 locks the seat 14 when the back 16 is moved from the upright position as shown.

The lower cross beam 24 includes a back support connector 32. The back support connector 32 receives a portion of the lower back support 20 to lock the seat 14 when the back 16 is lowered to a flat position.

Figure 2:
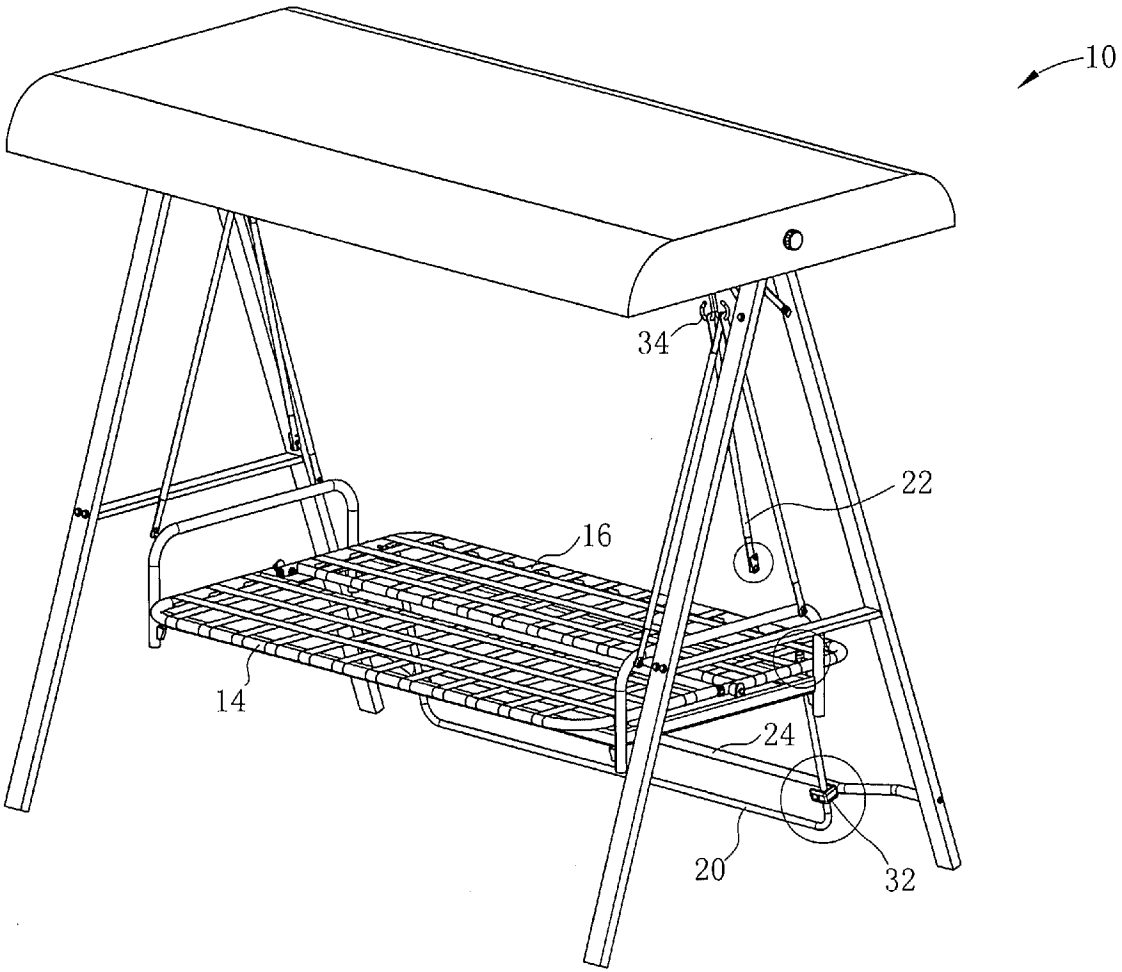
FIG. 2 shows a perspective view of a swing assembly of FIG. 1 having the back folded into a flat configuration.

FIG. 2 shows the swing assembly 10 with the back folded in a flat configuration. The seat 14 and the back 16 are generally co-planar to enable the user to lie on the swing assembly 10. The upper back supports 22 are detached from the back 16 to lay the back in the flat configuration. For reasons of safety and comfort the seat 14 is locked. Preferably the lower back support 20 locks seat to the lower crossbar 24. The lower crossbar 24 includes the back support connector 32 to enable the lower crossbar 24 to securely lock the seat 14.

The back support connector 32 has a generally "C" shaped channel to receive the lower back support 20. Folding back 16 flat causes the lower back support 20 to insert within the back support connector 32. Lifting the back 16 to an upright configuration as shown in FIG. 1 slidably lifts the lower back support 20 from the back support connector 32 to unlock the seat 14. The shape of the back support connector 32, including the channel, cooperates with the seat back 16 when the seat back 16 folds flat to automatically lock the seat 14 from swinging. In accordance with an embodiment of the present invention, while the lower back support 20 is coupled to the back support connector 32 in the flat or lowered configuration, the lower back support 20 may contact the ground to provide additional stability and support to the swing assembly.

Accordingly, the seat 14 of the swing assembly 10 automatically locks when the seat back 16 is folded flat, and the seat 14 automatically unlocks when the seat back 16 lifts from the flat configuration to the upright configuration.

Figure 3:
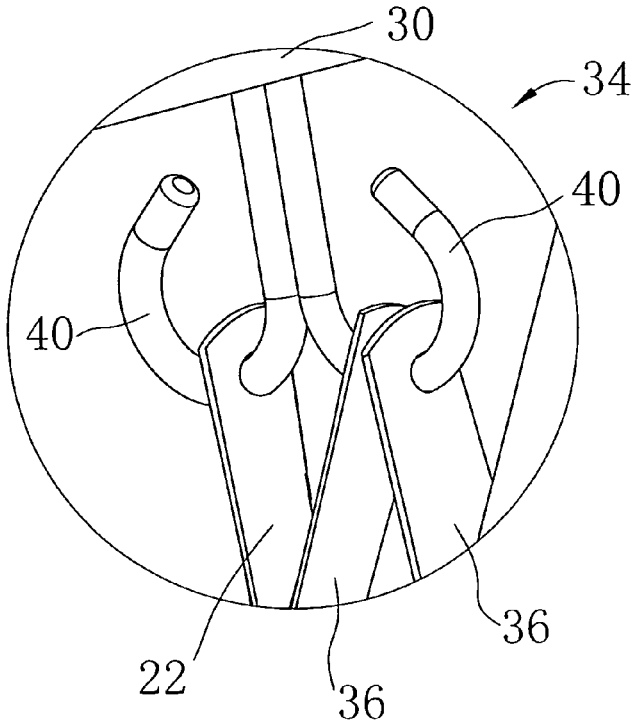
FIG. 3 shows hanging supports in accordance with the present invention.

FIG. 3 shows the hanging support 34. The hanging support 34 hangs from the upper cross beam 30. The hanging supports 34 include a pair of opposing hooks 40. The hooks 40 moveably hang upper back supports 22 and the seat supports 36. Preferably the upper back support 22 and the seat supports 36 are strips having reasonably good tensile strength. The ends of the back support 22 and the seat supports 36 each include a hole to enable a rotatable interconnection with the hooks 40.

Figure 4:
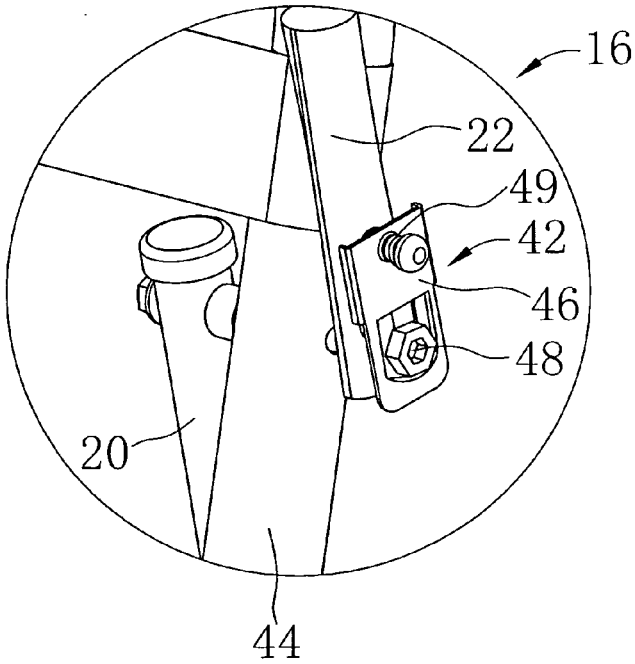
FIG. 4 shows a lock for an upper back support.

FIG. 4 shows a portion of the back 16 of the seat 14. The back 16 of the seat 14 includes a lateral end 44. In particular, FIG. 4 shows the portion of the back 16 where the end 42 of the upper back support 22 connects to the lateral end 44 of the back 16. The lower back support 20, the end 42, and the lateral end 44, movably interconnect.

The end 42 particularly includes a lock 46 which locks the end 42 of the upper back support 22 on the lateral end 42 of the back 16. The lock 46 enables selective locking and removal of the upper back support 22 from the lateral end 44 of the back 16.

The lock 46 cooperates with a shaft 48, which extends through the lateral end 44 of the back and the lower back support 20. The lock 46 includes a spring 49 that preloads the lock 46 against the upper back support 22 to secure the upper back support 22 onto the shaft 48. The lock 46 removeably attaches to the shaft 48.

Figure 5:
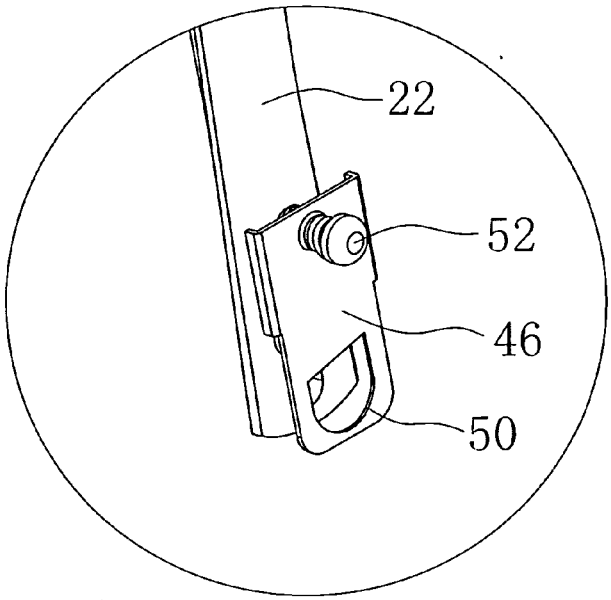
FIG. 5 shows the lock of FIG. 4 cooperating with a pivot in a locked configuration.
Figure 6:
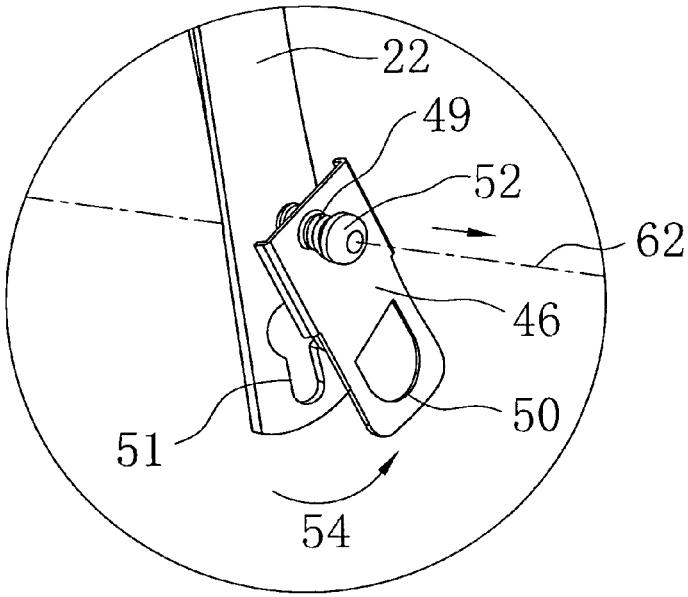
FIG. 6 shows the lock of FIG. 5 releasing by rotation.

FIG. 5 shows the lock 46 affixed on the upper back support 22. The lock has a pivot 52. The lock defines a periphery 50 defining an opening for removeably receiving the shaft 48 (FIG. 4). FIG. 6 shows the lock 46 rotating about the pivot 52 in the direction of the arrow 54 revealing an opening 51 of the upper back support 22.

Normally the opening defined by the periphery 50 and the opening 51 align during use. The pivot 52 and the spring 49 enable axial movement of the lock 46. Axial movement of the pivot 52 enables rotation of the lock 46 in the direction of the arrow 54 to selectively unlock the lock from the shaft 48 (FIG. 4). An axis 62 is shown. The pivot 52 is operated by pulling the pivot along the axis 62 to enable the lock to rotate and unlock from the shaft 48 (FIG. 4). Unlocking the lock 46 and removing the upper back support 22 from the back 16 of the seat enables the back 16 to fold flat (FIG. 2).

Figure 7:
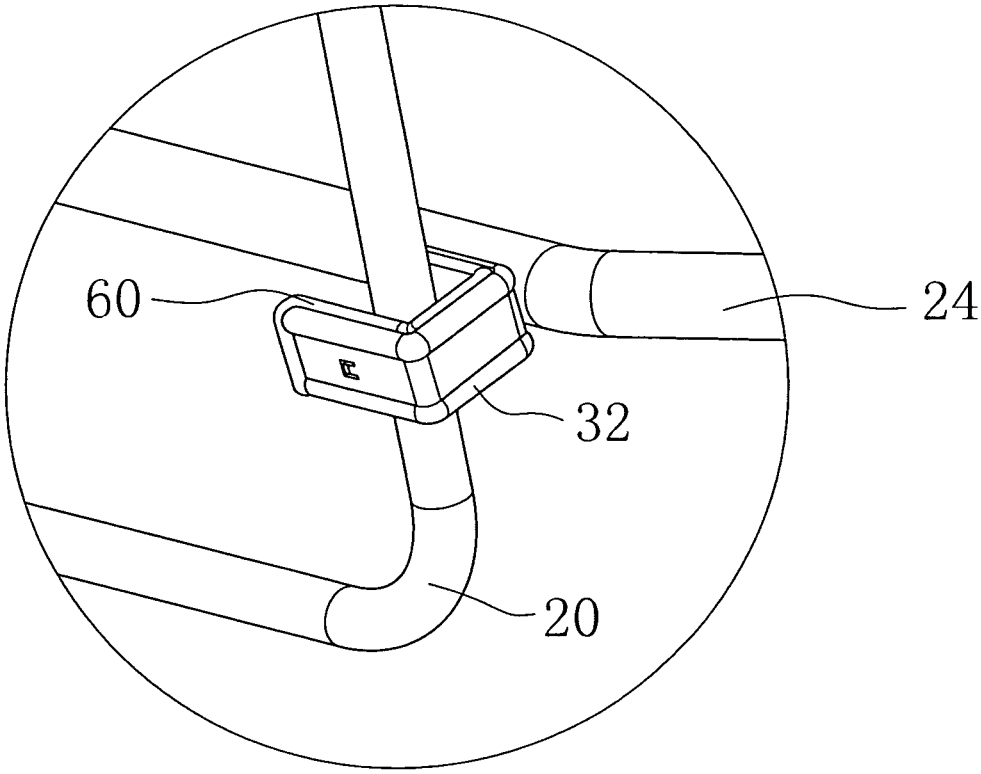
FIG. 7 shows a back support connector holding the lower back support.

FIG. 7 shows the lower back support connector 32 mounted on the lower cross bar 24. The lower back support 20 comprises rounded tube, having a bend that eases insertion into the back support connector 32.

The lower back support 20 inserts into a channel 60 defined by the lower back support connector 32. Preferably the lower back support connector 32 has a "C" shaped cross-section as shown. It can be appreciated however any of a number of configurations may be possible to enable the lower back support 20 to lock the seat of the swing assembly when the back of the seat assembly folds flat.

Figure 8:
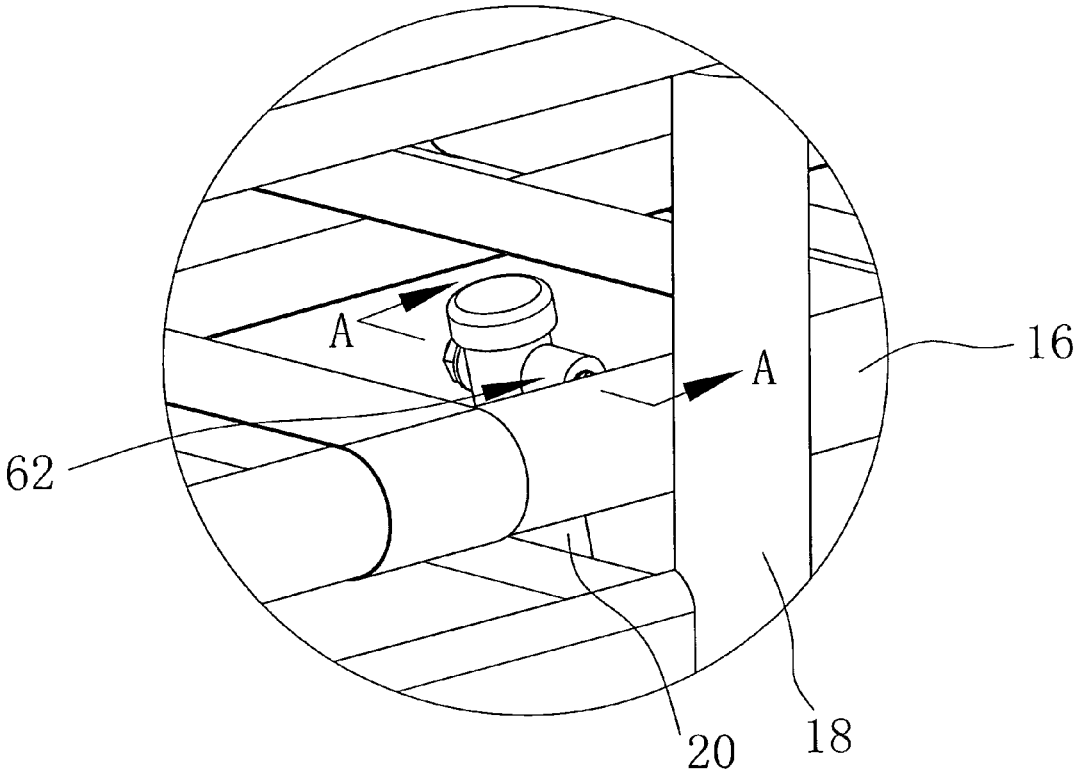
FIG. 8 shows a rotatable multi support connector attached to the lower back support and the back.

FIG. 8 shows one end of the lower back support 20 hanging from the back 16. The lower back support 20 particularly includes a rotatable multi support connector 62 that attaches to one end of the lower back support 20 and enables rotation between the lower back support 20 and the back 16 of the seat. In the upright configuration, the upper back support 22 attaches to the rotatable multi support connector 62 (not shown).

Figure 9:
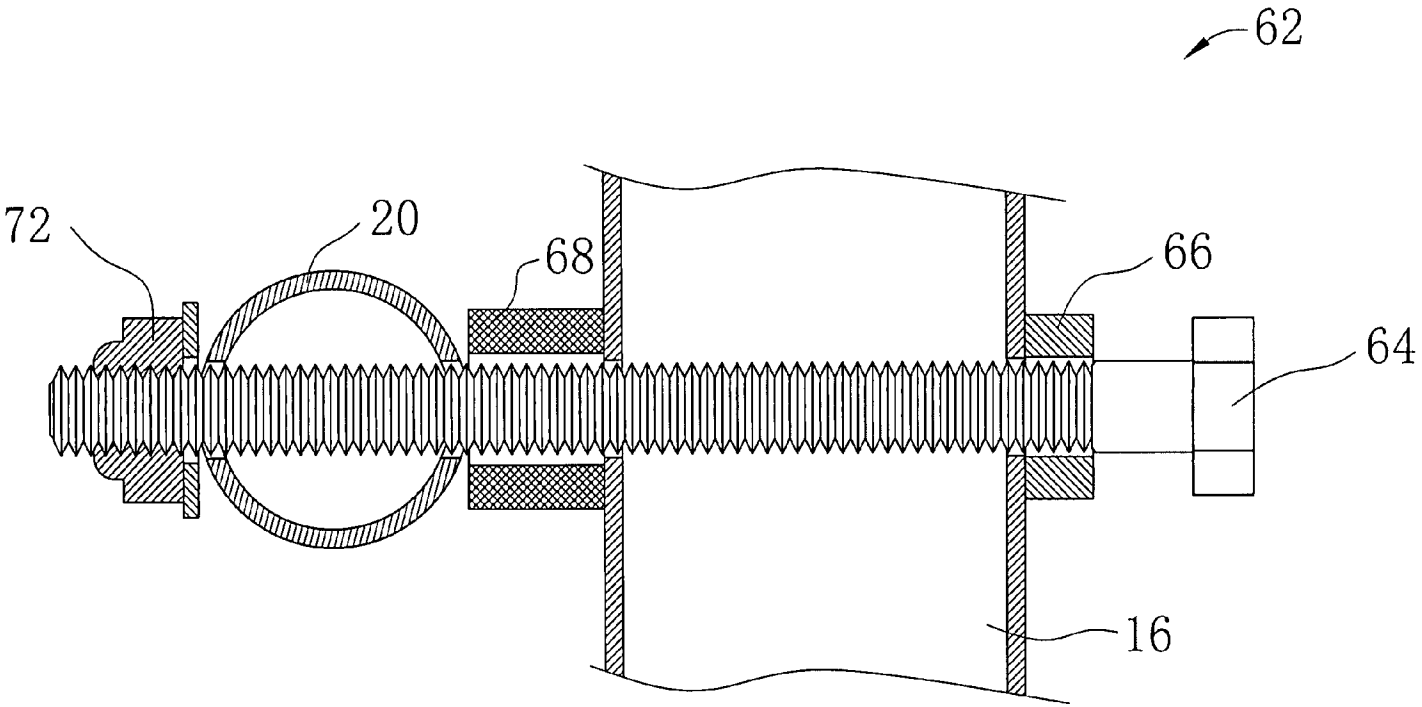
FIG. 9 shows a cross sectional view along A-A of the rotatable multi support connector.

FIG. 9 shows a cross sectional view along A-A of the rotatable multi support connector 62 of FIG. 8. The rotatable multi support connector 62 includes a bolt 64 having a bolt head 66, a bushing 68, and a nut 72. Tightening the bolt 64 compresses the nut 72 against lower back support 20, the bushing 68, the back 16, and the bolt head 66. The bushing 68 may flex under compression from the nut 72 and bolt head 66 and may be made from a polymeric material. The bushing 68 is rigid to hold the lower back support 20 in a press fit, while allowing the back 16 to rotate without loosening the bolt 64 from the nut 72. In an alternative embodiment, an end of the lower back support 20 being attached may include polymeric material in the form of an end cap to provide a snug compressive fit with the rotatable multi support connector thereby allowing a metal bushing 68 to be used.

While the present invention is described in terms of various embodiments, exemplary drawings and attendant descriptions are provided, it should be understood that the descriptions and drawings provide only practical examples of the nature of the invention. The actual scope of the invention is defined by the appended claims.

What is claimed is:

1. A swing assembly having a seat with a folding back comprising:

an upper cross bar having two ends and two hanging support hooks proximate to each end;

a lower cross bar having two ends and two back support connectors proximate to each end;

a lateral support attached to each end of the upper cross bar and the lower cross bar, respectively;

a seat hanging from the upper cross bar and having two ends and a backrest, the backrest foldably attaches to the seat;

a pair of upper back supports each having first ends attached to one of the hanging support hooks and second ends removably attached to each end of the backrest to hold the backrest in an upright configuration; and the backrest of the seat includes a lower back support rotatably attached to the second ends of the pair of upper back supports at each end of the backrest and is foldable to a flat configuration wherein the lower back support locks the seat to the back support connectors of the lower cross bar to prevent swinging movement when the pair of upper back supports are detached from each end of the backrest.

2. A swing assembly as set forth in claim 1, wherein the lower back support hangs from the backrest of the seat when the backrest is in the upright configuration.

3. A swing assembly as set forth in claim 2 further comprising a pair of multi support connectors each attached to an end of the backrest, an end of the lower back supports, and an end of the upper back supports, the connector including a bolt and a compression bushing.

4. A swing assembly as set forth in claim 3, wherein the two back support connectors attached proximate to each end of the lower cross bar have a "C" shape with a channel for automatically receiving the lower back support when the backrest of the seat folds into the flat configuration.

5. A swing assembly as set forth in claim 4, wherein the back support connector has a rounded joint to better enable the channel to automatically receive the lower back support.

6. A swing assembly as set forth in claim 5, wherein each upper back support is a strip living an end defining holes for enabling the upper back support and seat support to moveably hang on the upper cross bar, the upper cross bar has hooks, and the ends of the upper back support hangs on the hooks.

7. A swing assembly as set forth in claim 6, wherein each upper back support includes a lock to normally lock each upper back support to the multi support connector attached to the backrest.

8. A swing assembly as set forth in claim 7, wherein each lock includes a spring and a pivot with an axis, the pivot is axially moveable so that pulling the pivot along the axis compresses the spring to enable the lock to pivot and release the upper back support from the multi support connector.

9. A swing assembly having a canopy and a seat with a folding backrest comprising:

an upper cross bar having a canopy and two ends;

a lower cross bar having two ends;

a lateral support attached to each end of the upper cross bar and the lower cross bar, respectively;

a seat having two ends and a backrest, the backrest foldably attaches to the seat;

a pair of seat supports attached to each end of the seat;

a hanging support mounted on the upper cross bar adjacent each lateral support;

each seat support moveably attaches to the hanging support to enable the seat to swing; and a lower back support hanging from the backrest of the seat, the lower back support automatically locks against the lower cross bar when the backrest of the seat is foldable to a flat configuration to prevent swinging movement of the seat, wherein the lower cross bar has a back support connector;

wherein the back support connector has a "C" shape with a channel for automatically receiving the lower back support when the backrest of the seat folds into the flat configuration;

wherein the hanging support includes opposing hooks; and wherein an upper back support having a first end is movably attached to an opposing hook of the hanging support and having a second end is removeably attached to the backrest of the seat for holding the backrest of the seat in an upright configuration.

10. A swing assembly as set forth in claim 9 further comprising a multi support connector each attached to an end of the backrest, an end of the lower back supports, and an end of the upper back supports, the connector including a bolt and a compression bushing.

11. A swing assembly as set forth in claim 10, wherein the upper back support and seat supports are strips having ends defining holes for enabling the upper back support and seat support to hang on the hooks.

12. A swing assembly as set forth in claim 11, wherein each upper back support includes a lock to normally lock each upper back support to the multi support connector or the backrest.

13. A swing assembly as set forth in claim 12, wherein each lock includes a spring and a pivot with an axis, pulling the pivot along the axis compresses the spring to enable the lock to pivot and release the upper back support from the multi support connector of the backrest.

* * * * *